United States Patent [19]

Audeh et al.

[11] 4,240,901

[45] Dec. 23, 1980

[54] PROCESS FOR REFINING HYDROCARBON OILS

[75] Inventors: Costandi A. Audeh, Princeton, N.J.; Tsoung-yuan Yan, Philadelphia, Pa.

[73] Assignee: Mobil Oil Corporation, New York, N.Y.

[21] Appl. No.: 34,834

[22] Filed: Apr. 30, 1979

[51] Int. Cl.[3] ..... C10G 21/00

[52] U.S. Cl. ..... 208/324; 208/339; 208/323

[58] Field of Search ..... 208/311, 324, 339, 323

[56] References Cited

U.S. PATENT DOCUMENTS

| | | | |
|---|---|---|---|
| 2,188,012 | 1/1940 | Pilat et al. | 208/324 |
| 2,188,013 | 1/1940 | Pilat et al. | 208/324 |
| 2,315,131 | 3/1943 | Pilot et al. | 208/324 |
| 2,865,852 | 12/1958 | Davies | 208/339 |
| 2,911,361 | 11/1959 | Kleiss | 208/339 |

OTHER PUBLICATIONS

Priestly et al., "Chemistry and Industry", Oct. 7, 1978, pp. 757-776.

*Primary Examiner*—Herbert Levine

*Attorney, Agent, or Firm*—Charles A. Huggett; Vincent J. Frilette

[57] ABSTRACT

An improved solvent refining process for hydrocarbon oils such as asphalt-free lube fractions and diesel fuels is provided by recycling an inert gas such as nitrogen through the contact zone of the extraction tower.

6 Claims, 1 Drawing Figure

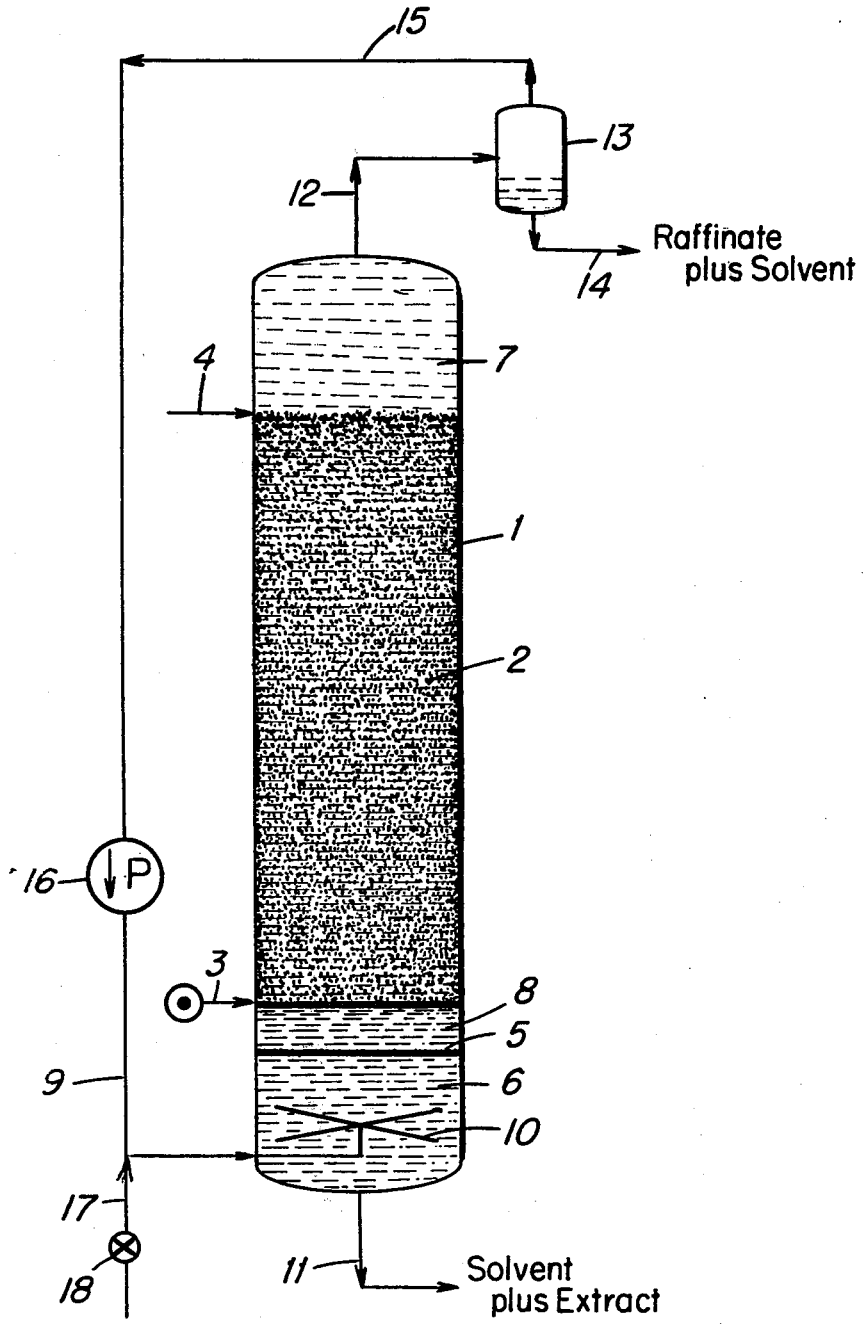
15
13
12
Raffinate
plus Solvent
14
4
7
1
2
16
P
3
8
5
9
6
10
17
18
11
Solvent
plus Extract

PROCESS FOR REFINING HYDROCARBON OILS

BACKGROUND OF THE INVENTION

1. Field of the Invention

This invention is concerned with refining lubricating oils. In particular, it is concerned with an improved process for solvent extraction of hydrocarbon oils to remove unstable and low viscosity index (V.I.) components therefrom. It is further concerned with the refining of lubricating oils by extraction with phenol or furfural solvent.

2. Background of the Invention

Solvent refining is used in the petroleum industry on a broad scale for the removal of low viscosity index and chemically unstable materials from petroleum lube fractions which do not contain asphalt. Solvents such as furfural, phenol, chlorex, and nitrobenzene have been generally recognized as commercially practical for single-solvent refining. All of these solvents are organic chemicals heavier than the lube fractions to be treated and capable of removing undesirable constituents by the physical action of preferential solution. In general, the choice of a particular solvent process is an economic consideration since all of them are capable of producing essentially the same finished oil within the broad range of theoretically possible operating conditions.

In a furfural extraction unit, which is typical, oil is introduced into the side of a tower containing suitable means, such as a packing, to insure intimate mixing with the solvent which is introduced near the top. The solvent being heavier flows to the bottom of the tower while the oil flows to the top. As these two flow countercurrently through the tower the solvent extracts the undesirable material from the oil. The material from the top of the tower is paraffinic and is known as the raffinate. It is the refined oil with a relatively small amount of dissolved solvent. The material from the bottom of the tower is known as the extract. It is the balance of the solvent containing the undesirable material. Both streams are transferred through a heater to separate solvent recovery towers. In these towers, which are similar to distillation columns, the solvent is vaporized and removed from the raffinate and extract. The physical nature of the process is demonstrated by the fact that it would be possible to recombine the raffinate and extract to secure a material identical in all respects to that charged to the process. This is also true of other solvent extraction processes. The refiner maintains control over the quality of the product by varying the quantity of the solvent and the temperature gradient within the extraction tower.

In spite of its industrial acceptance, there are problems associated with the solvent extraction process. For example, the tower packing becomes fouled with use, gradually reducing the efficiency of the operation and finally requiring shutdown for cleaning. Fouling is particularly severe with furfural as the solvent due to its propensity to oxidize and resinify, but phenol also tends to oxidize and in time forms deposits of oxalic acid. In addition, solvent extraction is a fairly expensive operation as it is now practiced, and there is a need for improvement of efficiency.

A publication titled "Gas Agitated Liquid Extraction Columns" by Ronald Priestley and Stephen R. M. Ellis appeared on pages 757–760 of the October 7, 1978 issue of Chemistry and Industry. Attention is called to this publication and the references contained therein for possible relevance to the present invention.

It is an object of this invention to provide a solvent-extraction process of improved efficiency for refining an asphalt-free hydrocarbon oil. It is a further object of this invention to provide means for modifying existing plants to increase throughput without altering product quality. It is a further object of this invention to provide a solvent-extraction process which conserves energy. These and other objects will become apparent to one skilled in the art on reading this entire specification including the claims thereof.

BRIEF DESCRIPTION OF THE DRAWING

The drawing illustrates a continuous solvent extraction tower provided with means for recycle of an inert gas.

DESCRIPTION OF THE INVENTION

The improved process of this invention, as more fully described hereinbelow, comprises solvent-extracting an asphalt-free hydrocarbon oil at elevated temperature by continously passing the raw oil and solvent to a contact zone contained in a closed vessel while upwardly flowing an inert gas saturated with solvent through said contact zone, recovering said gas from said vessel and recycling it back to the contact zone. By continuous recycle of the inert gas containing solvent vapor, the efficiency of the extraction tower is dramatically improved and introduction of impurities, particularly oxygen, into the vessel is avoided.

The process of this invention will now be described with reference to the drawing. Into a vessel (1), which is closed and provided with means for introducing and withdrawing fluids as required, said vessel containing a packing (2), is introduced via line (3) an asphalt-free raw hydrocarbon oil. The point of introduction of the raw oil is at or near the lower end of the packing (2), which may be any suitable conventional packing such as Raschig rings, Pall rings, Berl saddles or other. A selective solvent is introduced into vessel (1) via line (4) at or near the top of the packing (2). Any selective solvent that has a density greater than that of the raw hydrocarbon oil may be used, including furfural, phenol, chlorex, N-methyl pyrrolidone or other. Furfural and phenol are preferred as being effective and relatively inexpensive. The raw oil and solvent are contacted in the contact zone defined by the packing (2) wherein two phases are formed, the raffinate which contains some solvent and the extract phase which contains a major fraction of the solvent. These phases separate in vessel (1) in the region below the contact zone (2) and form interface (5), below which is the solvent plus extract (6) and above which is the mixed dispersed phase (8). The raffinate phase fills the upper region (7) of vessel (1) above the contact zone (2). Concurrent with the introduction of raw oil and solvent, inert gas is introduced into vessel (1) via line (9) at some point near or below the lower end of the contact zone defined by the packing (2). Line (9) preferably communicates with means (10) such as a sparger for distributing the inert gas uniformly over the cross-section of vessel (1). It is preferred to introduce and distribute the gas below meniscus (5) i.e. in the settling zone, since the flow of gas will assist in the coalescence of the raffinate droplets dispersed in extract phase (6). Inert gas introduced via line (9) flows upwardly through contact zone (2) and is mingled with raffinate phase (7). Concurrent with the introduction of raw hydrocarbon oil and solvent to vessel (1), the extract phase is withdrawn from vessel (1) via line (11) and the raffinate phase plus inert gas is withdrawn via line (12), the withdrawing being conducted in such fashion that meniscus (5) is maintained substantially at the desired level in the vessel. The foregoing extraction process is conducted at a temperature at least about 150° F., usually in the range of 150° F. to 275° F., and below the boiling point of the solvent. A temperature gradient may be maintained, if desired, in vessel (1) by means not shown and known to those skilled in the art. The raffinate phase plus inert gas withdrawn via line (12) is passed to gas-liquid separator (13) maintained at about the extraction temperature. Inert gas saturated with solvent vapor is withdrawn from the separator (13) via line (15) and passes through pump means (16) such as a compressor or fan to line (9) for recycling to the vessel, preferably without substantial reduction of temperature. Raffinate phase is withdrawn substantially free of inert gas from separator (13) via line (14). The raffinate plus solvent withdrawn from line (14) and the extract phase withdrawn from line (11) are passed to conventional solvent-recovery means (not shown) and the recovered solvent is reused in the extraction process. Whereas it is contemplated that the process of this invention will operate with substantially no consumption of inert gas, means for adding small amounts of makeup as may be needed are provided via line (17) and valve (18).

A wide variety of inert gases free of deleterious impurities such as oxygen and sulfur dioxide may be used in the process of this invention. These include nitrogen, carbon dioxide, helium, neon, argon, krypton, xenon, hydrogen, gaseous hydrocarbons such as methane, ethane, propane, ethylene, propylene, butane, and mixtures thereof. Superheated steam may be used as the inert gas when the temperature of extraction is at least 225° F. The term "inert" as used herein means that the gas does not react with the solvent, with itself, or with the raw hydrocarbon oil under extraction conditions, even over protracted periods of time. Within the foregoing limitations, the choice of inert gas is a matter of convenience and of economics, but in general those inert gases that have the lowest solubility in the solvent and in the hydrocarbon oils at the temperature of extraction are preferred. For purposes of this invention, the rate at which the inert gas is to be flowed upwardly through the contact zone is best expressed in terms of the ratio of throughputs, i.e. in terms of volume of inert gas saturated with solvent at atmospheric pressure and at mean extraction temperature introduced into the extraction vessel per hour per total volume of liquids introduced into the vessel per hour, said volume of liquids being of course the sum of the volumes of raw oil feed and solvent. For purposes of this invention, this ratio will be referred to herein and in the claims as the "gas to liquid volume ratio". This ratio is dimensionless, i.e. the same unit of volume is chosen to express both the gas and the liquid volume. Good results are obtained in this invention with a gas to liquid volume ratio of about 0.05 to about 2.0, the preferred ratio being from about 0.10 to about 0.50. In the foregoing discussion the inert gas volume is computed at atmospheric pressure since it is contemplated to operate the extraction at about atmospheric pressure.

A variety of hydrocarbon oils may be solvent-extracted by the process of this invention. For example, diesel oils may be treated to increase the cetane value thereof. The invention is particularly useful in refining petroleum lubricant base stocks having an initial boiling point of at least about 450° F. to extract therefrom low V.I. and unstable constituents. Distillate pertroleum fractions boiling in the range of 600° to 1050° F., for example, may be so treated.

It is a feature of this invention that the improved process may be practiced in conventional equipment with only minor modification to provide inert gas recycle, which requires little capital investment. With such modification, the refiner may choose to decrease his usual solvent to oil ratio used in processing a lube base stock, for example from 2.0 to 1.75 or lower, thereby reducing solvent recovery costs while maintaining product quality. Or, he may maintain his usual solvent-/oil ratio and increase throughput, thereby increasing plant capacity. In any case, the process provided by this invention is available to reduce the cost, or improve the quality, of solvent refined oils.

What is claimed is:

1. In a continuous solvent extraction process for removing undesirable components from a hydrocarbon oil, which process comprises introducing an asphalt-free hydrocarbon oil into the lower end of a contact zone contained in a vessel while introducing a selective solvent into the upper end of said contact zone, contacting the raw hydrocarbon oil and solvent in said contact zone at about atmospheric pressure and at a temperature at least about 150° F. but below the boiling point of said solvent thereby forming a raffinate plus solvent phase and a solvent plus extract phase, separating said phases in a settling zone within said vessel, upwardly flowing and recovering said raffinate plus solvent phase from said vessel, and downwardly flowiing and recovering said solvent plus extract phase from said vessel; the improvement, whereby improving the efficiency of said process, which comprises upwardly flowing through said contact zone an inert gas saturated with said solvent, recovering said saturated inert gas and recycling it to said contact zone.

2. The process claimed in claim 1 wherein said saturated inert gas is flowed upwardly through said contact zone at a gas to liquid volume ratio of about 0.05 to about 2.0.

3. The process claimed in claim 1 wherein said saturated inert gas is recycled to said contact zone by introduction into said settling zone.

4. The process claimed in claim 3 wherein said saturated inert gas is flowed upwardly through said contact zone at a gas to liquid volume ratio of about 0.05 to about 2.0.

5. The process described in claim 1 or claim 2 or claim 3 or claim 4 wherein said selective solvent is furfural or phenol.

6. The process described in claim 1 or claim 2 or claim 3 or claim 4 wherein said selective solvent is furfural or phenol, said contacting zone temperature is at least 225° F., and said inert gas is superheated steam.

* * * * *